US009994368B2

(12) United States Patent
Pagan et al.

(10) Patent No.: US 9,994,368 B2
(45) Date of Patent: Jun. 12, 2018

(54) CLOSURE FOR A CONTAINER

(71) Applicant: The Procter & Gamble Company, Cincinnati, OH (US)

(72) Inventors: Alfredo Pagan, Mason, OH (US); Brian David Andres, Harrison, OH (US); Cristian Alexis Violaprioli, Loveland, OH (US); Su-Yon McConville, Mason, OH (US); Tuan Huu Nguyen, Milford, NH (US); John Robert Stephenson, Raleigh, NC (US)

(73) Assignee: The Procter & Gamble Company, Cincinnati, OH (US)

( * ) Notice: Subject to any disclaimer, the term of this patent is extended or adjusted under 35 U.S.C. 154(b) by 125 days.

(21) Appl. No.: 14/067,522

(22) Filed: Oct. 30, 2013

(65) Prior Publication Data

US 2017/0144803 A1 May 25, 2017

Related U.S. Application Data

(60) Provisional application No. 61/720,172, filed on Oct. 30, 2012.

(51) Int. Cl.

| | |
|---|---|
| ***B65D 47/00*** | (2006.01) |
| ***B67D 3/00*** | (2006.01) |
| ***B65D 41/16*** | (2006.01) |

(52) U.S. Cl.

CPC ..... *B65D 41/16* (2013.01)

(58) Field of Classification Search

CPC .... B65D 47/241; B65D 47/242; B65D 41/16; B65D 41/0435

(Continued)

(56) References Cited

U.S. PATENT DOCUMENTS 365,065 A 6/1887 Grinnell
1,760,946 A * 6/1930 Hammerstein ..... 222/505

(Continued)

FOREIGN PATENT DOCUMENTS

BR 9505903 A 1/1998
CH 598931 A5 5/1978

(Continued)

OTHER PUBLICATIONS

"Snap" Merriam-Webster.com. Merriam-Webster, Apr. 11, 2016.*

(Continued)

*Primary Examiner* — Benjamin R Shaw
(74) *Attorney, Agent, or Firm* — Linda M. Sivik

(57) ABSTRACT

The present invention is directed to a closure for an outlet opening of a container comprising a first component which snaps onto an outlet opening and provides a seal for an outlet opening said first component snaps with a second component of said closure; wherein the first component comprises one or more rails to enable stability of the assembly and defines the direction of movement of the second component relative to the first component; a second component comprising a dispensing orifice of said second component, said second component, snaps with said first component; wherein the second component comprises ribs which engage the rail(s) of said first component; a dispensing orifice positioned directly adjacent to the open portion of the container body; wherein one or more directions of the movement of the second component relative to the first component are independently controlled by rails and ribs.

28 Claims, 13 Drawing Sheets

(58) Field of Classification Search
USPC ..... 222/549, 553, 521; 220/212, 288, 290
See application file for complete search history.

(56) References Cited

U.S. PATENT DOCUMENTS

| | | | | |
|---|---|---|---|---|
| 1,974,348 | A * | 9/1934 | Strehs | 222/507 |
| 2,044,508 | A * | 6/1936 | Parkin | 222/521 |
| 2,209,050 | A | 7/1940 | Church | |
| 2,216,253 | A | 10/1940 | Schneider et al. | |
| 3,111,245 | A | 11/1963 | Libit et al. | |
| 3,374,917 | A | 3/1968 | Troy | |
| 3,541,640 | A | 11/1970 | Stefaniak et al. | |
| 3,542,256 | A | 11/1970 | Waterman | |
| 3,765,574 | A | 10/1973 | Urquiza | |
| 4,251,366 | A | 2/1981 | Simon et al. | |
| 4,273,248 | A | 6/1981 | Lehmann | |
| D263,805 | S | 4/1982 | Seager | |
| 4,506,489 | A | 3/1985 | Schieser et al. | |
| 4,605,135 | A | 8/1986 | Ryder | |
| 4,690,304 | A * | 9/1987 | Morel | 222/44 |
| 4,867,354 | A | 9/1989 | Schreiber | |
| 4,883,631 | A | 11/1989 | Ajmera | |
| 4,967,941 | A * | 11/1990 | Beck | 222/521 |
| 5,051,084 | A | 9/1991 | Guarriello et al. | |
| 5,092,474 | A | 3/1992 | Leigner | |
| 5,209,891 | A | 5/1993 | Guarriello et al. | |
| 5,251,793 | A * | 10/1993 | Bolen et al. | 222/546 |
| 5,265,777 | A | 11/1993 | Weinstein | |
| 5,279,440 | A | 1/1994 | Fougeres et al. | |
| 5,305,932 | A * | 4/1994 | Iseli | 222/521 |
| 5,364,675 | A | 11/1994 | Guarriello et al. | |
| 5,383,558 | A | 1/1995 | Wilkinson et al. | |
| 5,385,250 | A | 1/1995 | Pasquale | |
| 5,503,886 | A | 4/1996 | Guarriello et al. | |
| 5,505,612 | A | 4/1996 | Mero et al. | |
| 5,544,790 | A | 8/1996 | Lu | |
| 5,609,276 | A | 3/1997 | Greatbatch | |
| 5,709,318 | A | 1/1998 | Oder | |
| 5,823,345 | A | 10/1998 | Nask et al. | |
| 5,850,950 | A * | 12/1998 | Hofmann | 222/519 |
| 5,913,446 | A | 6/1999 | von Holdt, Sr. et al. | |
| 5,918,777 | A | 7/1999 | Flak | |
| 5,921,416 | A | 7/1999 | Uehara | |
| 5,962,039 | A | 10/1999 | Katou et al. | |
| 6,029,866 | A | 2/2000 | Wood et al. | |
| 6,041,975 | A | 3/2000 | Flak | |
| 6,074,596 | A | 6/2000 | Jacquet | |
| 6,131,755 | A | 10/2000 | Soyka, Jr. et al. | |
| 6,135,329 | A * | 10/2000 | Stoneberg et al. | 222/521 |
| 6,159,416 | A | 12/2000 | Kawakami et al. | |
| D435,793 | S | 1/2001 | Kreiseder | |
| D438,114 | S | 2/2001 | Stonberg | |
| D440,495 | S | 4/2001 | Hathaway | |
| 6,290,094 | B1 | 9/2001 | Arnold et al. | |
| 6,299,038 | B1 * | 10/2001 | Schmeisser et al. | 222/521 |
| 6,302,286 | B1 | 10/2001 | Witherspoon | |
| 6,325,252 | B1 | 12/2001 | Brozell et al. | |
| 6,338,425 | B1 * | 1/2002 | Berge et al. | 222/521 |
| 6,357,625 | B2 | 3/2002 | Kimble et al. | |
| 6,416,173 | B2 | 7/2002 | Kishida et al. | |
| 6,478,194 | B2 | 11/2002 | Haglund et al. | |
| 6,495,089 | B1 | 12/2002 | Crider | |
| 6,622,895 | B2 | 9/2003 | McClean et al. | |
| 6,669,049 | B2 | 12/2003 | Crider | |
| 6,691,394 | B1 | 2/2004 | McClean | |
| 6,811,047 | B1 | 11/2004 | Hicks et al. | |
| 6,845,889 | B2 | 1/2005 | Killoran et al. | |
| 7,097,059 | B2 | 8/2006 | Saito et al. | |
| 7,153,127 | B2 | 12/2006 | Struble et al. | |
| D573,469 | S | 7/2008 | Lamb et al. | |
| D574,241 | S | 8/2008 | Braukmann et al. | |
| 7,449,331 | B2 | 11/2008 | Whitley | |
| D613,160 | S | 4/2010 | Ablo | |
| 7,721,922 | B2 | 5/2010 | Balzeau | |
| 7,740,155 | B1 | 6/2010 | Gallegos | |
| 7,988,004 | B1 * | 8/2011 | Marret et al. | 215/252 |
| 8,070,003 | B2 | 12/2011 | True et al. | |
| 8,127,970 | B2 | 3/2012 | Cleary et al. | |
| 8,162,164 | B2 | 4/2012 | Podd et al. | |
| D670,164 | S | 11/2012 | Pagan et al. | |
| D672,243 | S | 12/2012 | Desoto-Burt et al. | |
| 9,205,592 | B2 | 12/2015 | Gerlach et al. | |
| 9,321,228 | B2 | 4/2016 | Desoto-Burt et al. | |
| 2002/0053524 | A1 | 5/2002 | Alticosalian | |
| 2002/0066755 | A1 | 6/2002 | Garibaldi | |
| 2004/0079769 | A1 | 4/2004 | Balzeau | |
| 2004/0262321 | A1 | 12/2004 | Takeda | |
| 2005/0139621 | A1 * | 6/2005 | Foster | 222/521 |
| 2005/0144913 | A1 | 7/2005 | Pagh | |
| 2005/0150889 | A1 * | 7/2005 | Perra | 220/254.1 |
| 2005/0170035 | A1 | 8/2005 | Chen | |
| 2006/0163190 | A1 | 7/2006 | Laveault | |
| 2006/0226110 | A1 | 10/2006 | Choi et al. | |
| 2007/0098935 | A1 | 5/2007 | Farran et al. | |
| 2007/0187277 | A1 | 8/2007 | Furlong | |
| 2007/0251959 | A1 | 11/2007 | Brotchner | |
| 2008/0037360 | A1 | 2/2008 | McGill | |
| 2008/0124432 | A1 | 5/2008 | Ma | |
| 2008/0128382 | A1 | 6/2008 | Yamamoto et al. | |
| 2008/0202966 | A1 | 8/2008 | Fields et al. | |
| 2009/0045157 | A1 | 2/2009 | Panchal et al. | |
| 2009/0078669 | A1 | 3/2009 | Sakaguchi et al. | |
| 2009/0101646 | A1 | 4/2009 | Paul et al. | |
| 2009/0127259 | A1 | 5/2009 | Heath et al. | |
| 2009/0145900 | A1 | 6/2009 | Maroofian et al. | |
| 2009/0236305 | A1 | 9/2009 | DeMarco et al. | |
| 2009/0293341 | A1 * | 12/2009 | Fleming | 43/113 |
| 2009/0301990 | A1 | 12/2009 | Cresswell et al. | |
| 2010/0095696 | A1 | 4/2010 | Norris et al. | |
| 2010/0108724 | A1 * | 5/2010 | Buchalter | 222/521 |
| 2010/0140280 | A1 | 6/2010 | Burke et al. | |
| 2010/0308043 | A1 | 12/2010 | Wimmer | |
| 2011/0137272 | A1 * | 6/2011 | Adams | 604/349 |
| 2012/0018120 | A1 | 1/2012 | Danko | |
| 2012/0031548 | A1 | 2/2012 | Broad | |
| 2012/0152882 | A1 | 6/2012 | Tune | |
| 2012/0181209 | A1 | 7/2012 | Desoto-Burt | |
| 2012/0181272 | A1 | 7/2012 | Desoto-Burt et al. | |
| 2012/0181278 | A1 | 7/2012 | Pagan et al. | |
| 2012/0181292 | A1 | 7/2012 | Desoto-Burt et al. | |
| 2012/0181302 | A1 | 7/2012 | Desoto-Burt | |
| 2013/0183462 | A1 | 7/2013 | Gerlach et al. | |
| 2013/0270306 | A1 * | 10/2013 | Krautkramer | 222/521 |

FOREIGN PATENT DOCUMENTS

| | | | |
|---|---|---|---|
| CN | 300919834 | A | 5/2009 |
| CN | 300990533 | A | 8/2009 |
| CN | 301056126 | A | 11/2009 |
| DE | 2542045 | A1 | 3/1977 |
| DE | 8808369 | U1 | 8/1988 |
| DE | 69119790 | T2 | 10/1996 |
| EM | 1174874.0004 | A | 1/2010 |
| EP | 0181115 | A2 | 8/1986 |
| EP | 0437332 | A | 7/1991 |
| EP | 0407976 | A | 1/1992 |
| EP | 0446991 | A | 9/1992 |
| EP | 0908393 | A | 4/1999 |
| EP | 0859720 | B1 | 5/2000 |
| EP | 911272 | A | 10/2000 |
| EP | 997289 | A | 4/2001 |
| EP | 1115647 | A1 | 7/2001 |
| EP | 1177988 | A | 2/2004 |
| EP | 1394052 | A1 | 3/2004 |
| EP | 1566359 | A1 | 8/2005 |
| EP | 1681243 | | 7/2006 |
| EP | 1826133 | A1 | 8/2007 |
| EP | 1870346 | A1 | 12/2007 |
| EP | 1930246 | A1 | 6/2008 |
| EP | 2216253 | A1 | 8/2010 |
| FR | 2737194 | B1 | 9/1997 |
| FR | 2752820 | A1 | 3/1998 |
| FR | 2803273 | A1 | 7/2001 |
| GB | 2150124 | A | 6/1985 |

(56) References Cited

FOREIGN PATENT DOCUMENTS

| | | | |
|---|---|---|---|
| GB | 2371041 | A | 7/2002 |
| JP | 60204630 | | 10/1985 |
| JP | 60220722 | A | 11/1985 |
| JP | 07125059 | | 5/1995 |
| JP | 7285167 | A | 10/1995 |
| JP | 3298742 | B2 | 12/1995 |
| JP | 7329132 | A | 12/1995 |
| JP | 8267520 | A | 10/1996 |
| JP | 9254203 | A | 9/1997 |
| JP | 10071634 | A | 3/1998 |
| JP | 11276948 | A | 10/1999 |
| JP | 2000024769 | A | 1/2000 |
| JP | 2001191373 | A | 7/2001 |
| JP | 2001310335 | A | 11/2001 |
| JP | 2002225908 | A | 8/2002 |
| JP | 3420319 | B2 | 6/2003 |
| JP | 2003181908 | A | 7/2003 |
| JP | 2003245957 | A | 9/2003 |
| JP | 3837590 | B2 | 10/2006 |
| JP | 2972791 | B2 | 9/2007 |
| JP | 4391813 | B2 | 12/2009 |
| JP | 4728062 | B2 | 7/2011 |
| KR | 2008003965 | A | 9/2008 |
| KR | 2010006308 | A | 1/2010 |
| NL | 1030528 | C2 | 5/2007 |
| WO | 9010532 | A1 | 9/1990 |
| WO | WO94/12426 | A1 | 6/1997 |
| WO | 03016157 | A | 2/2003 |
| WO | 201005607 | A | 1/2010 |

OTHER PUBLICATIONS

"Rail" Merriam-Webster.com. Merriam-Webster, Apr. 11, 2016.*
"Rib" Merriam-Webster.com. Merriam-Webster, Apr. 11, 2016.*
International Search Report; PCT/US2012/021262; Date of Mailing Jul. 31, 2012; 16 pages.
International Search Report PCT/US2012/021238; Mailing Date Mar. 23, 2012; 13 pages.
International Search Report PCT/US2012/021241; Mailing Date Apr. 26, 2012; 14 pages.
International Search Report PCT/US2012/021265; Mailing Date Mar. 22, 2012; 15 pages.
U.S. Appl. No. 13/350,336, USPTO Office Action dtd May 2, 2013.
U.S. Appl. No. 13/350,320, USPTO Office Action dated Jan. 4, 2013.
U.S. Appl. No. 13/350,320, USPTO Office Action dated May 15, 2013.
U.S. Appl. No. 13/350,301, USPTO Office Action dtd Sep. 5, 2013.
U.S. Appl. No. 13/350,320, USPTO Office Action dtd Oct. 8, 2013.
International Search Report PCT/US2013/067490; Mailing Date Feb. 19, 2014; 15 pages.
IPRP PCT/US2013/067490; International Filing Date Oct. 30, 2013; 9 pages.
"Thermoforming", The Wiley Encyclopedia of Packaging Technology, Edited by Brody, A.L. And Marsh, K.S., John Wiley & Sons, Inc., 2nd Edition, 1997, pp. 914 to 921.
All final and non-final office actions for U.S. Appl. No. 13/350,284.
All final and non-final office actions for U.S. Appl. No. 13/350,301.
All final and non-final office actions for U.S. Appl. No. 13/350,320.
All final and non-final office actions for U.S. Appl. No. 13/350,336.
All final and non-final office actions for U.S. Appl. No. 13/350,361.
All final and non-final office actions for U.S. Appl. No. 13/350,374.
All final and non-final office actions for U.S. Appl. No. 13/350,436.
All final and non-final office actions for U.S. Appl. No. 13/391,488.
PCT International Search Report and Written Opinion for PCT/US2012/020693 dated Aug. 20, 2012.
PCT International Search Report and Written Opinion for PCT/US2012/020869 dated Aug. 20, 2012.
PCT International Search Report and Written Opinion for PCT/US2012/021203 dated Aug. 20, 2012.
PCT International Search Report and Written Opinion for PCT/US2012/021268 dated Mar. 23, 2012.
PCT Invitation to Pay Additional Fees, and Where Applicable, Protest Fee for PCT/US2012/020869 dated Jun. 8, 2012.
PCT Invitation to Pay Additional Fees, and Where Applicable, Protest Fee, for PCT/US2012/020693 dated Jun. 8, 2012.
PCT Invitation to Pay Additional Fees, and Where Applicable, Protest Fee, for PCT/US2012/021203 dated Jun. 8, 2012.

* cited by examiner

Fig. 2A
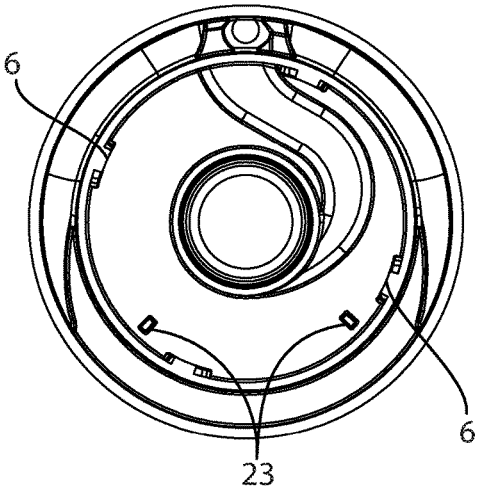
Fig. 2B
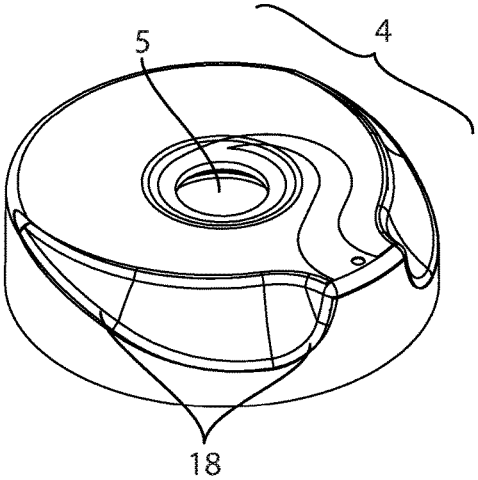
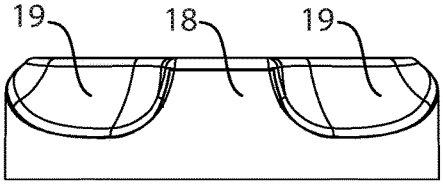
Fig. 2C
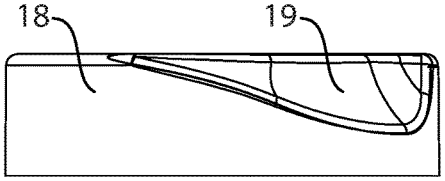
Fig. 2D
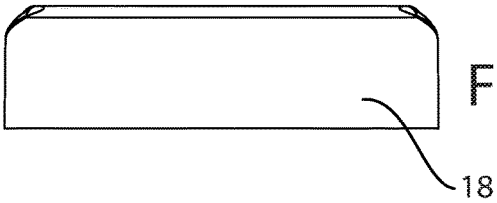
Fig. 2E
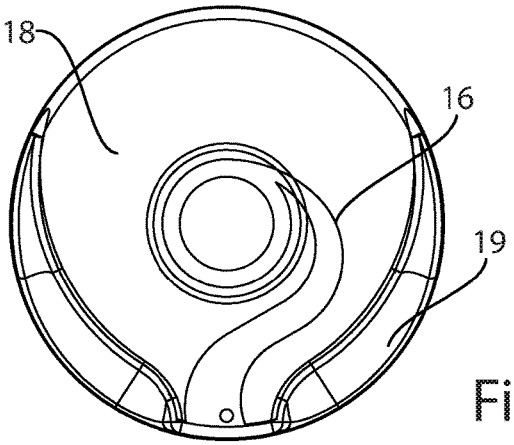
Fig. 2F

CLOSURE FOR A CONTAINER

FIELD OF THE INVENTION

The present invention relates to a closure for an outlet opening of a container comprising a closure for an outlet opening of a container comprising: a first component which snaps onto an outlet opening and provides a seal for an outlet opening said first component snaps with a second component of said closure; wherein the first component comprises one or more rails to enable stability of the assembly and defines the direction of movement of the second component relative to the first component; a second component comprising a dispensing orifice of said second component, said second component, snaps with said first component; wherein the second component comprises ribs which engage the rail(s) of said first component; and a dispensing orifice positioned directly adjacent to the open portion of the container body; wherein one or more directions of the movement of the second component relative to the first component are independently controlled by rails and ribs.

BACKGROUND OF THE INVENTION

A variety of packages, including dispensing packages or containers, have been developed for household products, personal care products, and other products. Currently, there are several closure designs on store shelves. They all vary from Disc/pivot top, push to open, flip top, push and pull, twist to open, as well as a variety of others. A current disadvantage of all these closures is that they don't take into consideration the ease of use, audible/tactile signals, intuitiveness, and ergonomic features that delights the consumer. In the present invention, all designs being developed take into consideration consumer insight. All closures represent one handed operation that demonstrates obviousness in open and close position with integrated locking feature. Also, the present invention will enable upright and inverted use of the package. Each closure is holistically designed to deliver intuitive operation; obviousness of being open or closed; ergonomic to operate; and providing all of the sensory (audible, tactile and visual) cues for operation. Further, the present invention expands on consumer insights that drive to efficiency per usage experience.

Currently, most closures complete the geometry of the container, thereby requiring the size of the closure to be proportional to the geometry of the container. In the present invention, the size of the closure is minimized thereby providing several benefits. One of the benefits is reducing the weight of the closure to the minimum amount of resin needed to enable the required closure functionality. This is a benefit for the environment as industry currently does not have a well established polypropylene recycling stream. By having a closure that has a reduced weight from the overall package, this allows a container to have improved recyclability. It also reduces the overall costs of the closure including costs associated with resin, processing, tooling, injection mold (IM) press selection, and others. Another benefit of minimizing closure size is that the closure becomes a less focal point of the design making it more inductive to use the same closure for different container designs within one brand and even enable the use of the same closure across different brands/shaped families. This drives optimization and efficiency and in return reduces further costs. This further enables the silhouette of the shape to be scaled proportionally without the use of additional features such as container shoulders (10) and angles to accommodate the closure.

Another benefit for minimizing the closure size is that it can be integrated in the container shape. When the container is in its inverted orientation, an integrated design allows the use of the container top surface to add stability vs. requiring a larger closure. This drives scale in the container design and development and therefore is an advantage. It also aids in creating differentiation between the forms (such as shampoo and conditioner), helping consumers identify the product that they are looking for.

In conventional twist to open closures, where the direction/movement and the retention of one piece to the other are achieved via the use of threads, the present invention enables the control of the direction and retention of both parts independently within each other via the use of ribs and rails. At the same time, the use of ribs and rails enables injection molding tool design simplification. The threads in a plastic component are conventionally molded via stripping the threads, unscrewing mechanism or by side actions in the too, in order to release the undercuts in the plastic component. By having side actions or unscrewing mechanism in the tool, it limits the amount of parts that may fit in the tool. This is due to the larger area of space needed to accommodate the mechanical (side action) components. This not only limits the size of the tool but also increases the tool cost, as well as increasing the maintenance of the tool. Further, in a conventional mold, by stripping the threads of the tool, it enables straight pull tool design while limiting the robustness of engagement between the plastic components. When stripping undercuts, there is a maximum possible undercut depth that the industry can strip today for a given hoop strength of a component, without damaging the component. This limits the robustness in stability and integrity of the assembly of both components. Therefore, the present invention enables straight pull tool design, while maintaining the integrity of both components as well as the stability of the assembly of the closure.

SUMMARY OF THE INVENTION

The present invention is directed to a closure for an outlet opening of a container comprising a closure for an outlet opening of a container comprising: a first component which snaps onto an outlet opening and provides a seal for an outlet opening said first component snaps with a second component of said closure; wherein the first component comprises one or more rails to enable stability of the assembly and defines the direction of movement of the second component relative to the first component; a second component comprising a dispensing orifice of said second component, said second component, snaps with said first component; wherein the second component comprises ribs which engage the rail(s) of said first component; and a dispensing orifice positioned directly adjacent to the open portion of the container body; wherein one or more directions of the movement of the second component relative to the first component are independently controlled by rails and ribs.

BRIEF DESCRIPTION OF THE DRAWINGS

FIG. 2A is a bottom view of a second component of a closure.

FIG. 2B is an isometric view of a second component of a closure.

FIG. 2C is a front view of a second component of a closure.

FIG. 2D is a side view of a second component of a closure.

FIG. 2E is a back view of a second component of a closure.

FIG. 2F is a top view of a second component of a closure.

DETAILED DESCRIPTION OF THE INVENTION

Figure 1A:
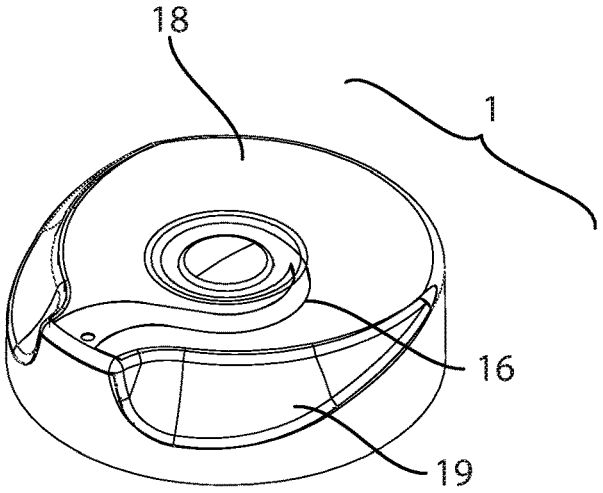
FIG. 1A is an isometric view of a closure.
Figure 1B:
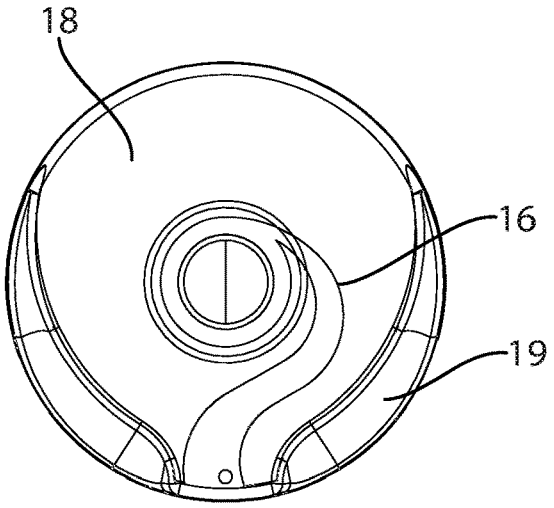
FIG. 1B is a top view of a closure.
Figure 3A:
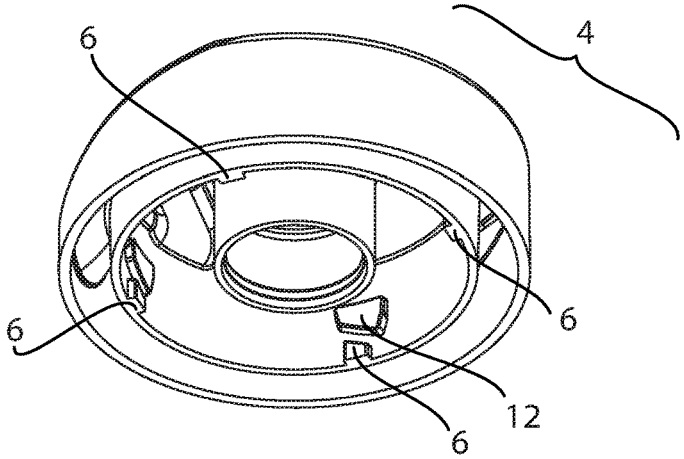
FIG. 3A is an isometric view of a second component of a closure.
Figure 3B:
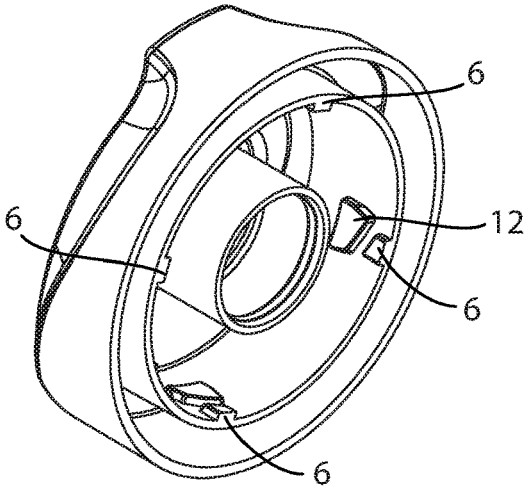
FIG. 3B is an isometric view of a second component of a closure.
Figure 3C:
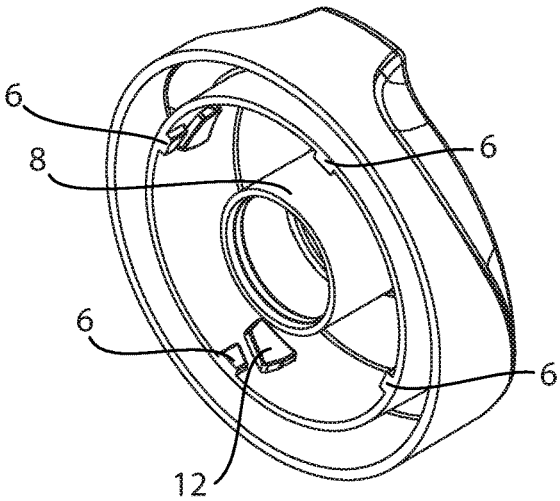
FIG. 3C is an isometric view of a second component of a closure.
Figure 4A:
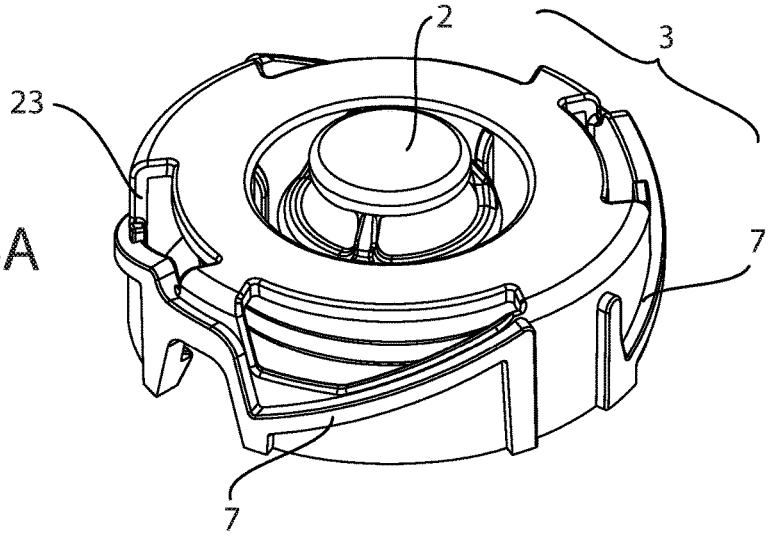
FIG. 4A is an isometric view of a first component of a closure.
Figure 4B:
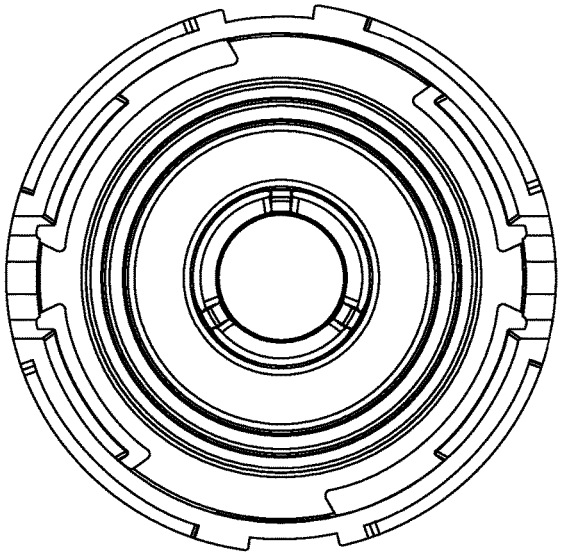
FIG. 4B is a bottom view of a first component of a closure.
Figure 4C:
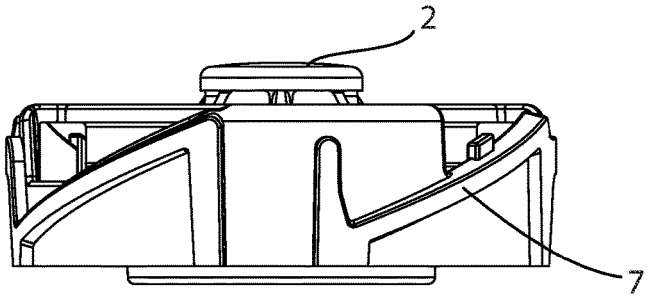
FIG. 4C is a side view of a first component of a closure.
Figure 5A:
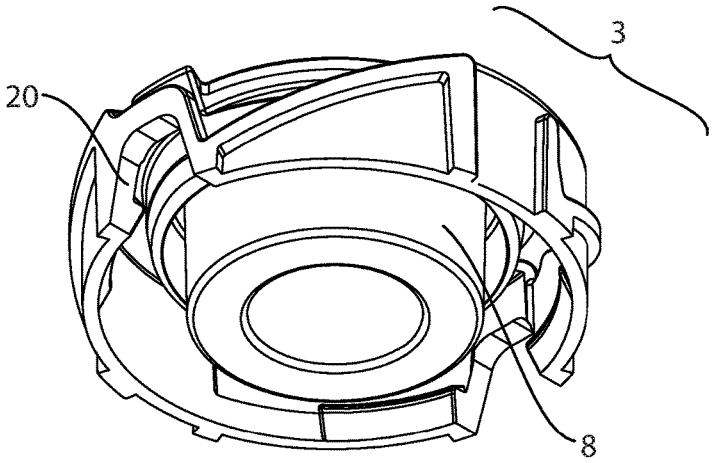
FIG. 5A is an isometric view of a first component of a closure.
Figure 5B:
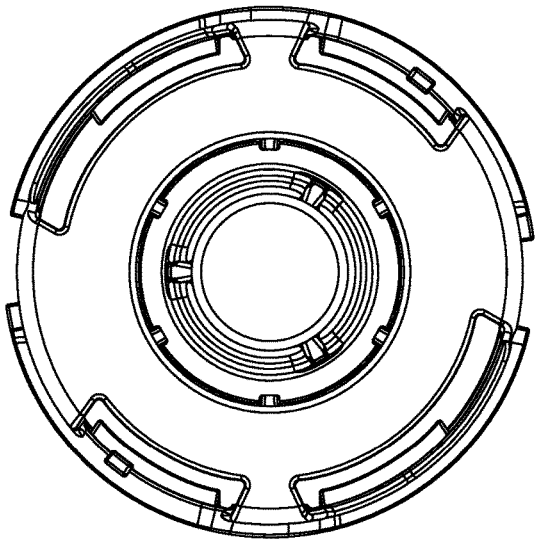
FIG. 5B is a bottom view of a first component of a closure.
Figure 5C:
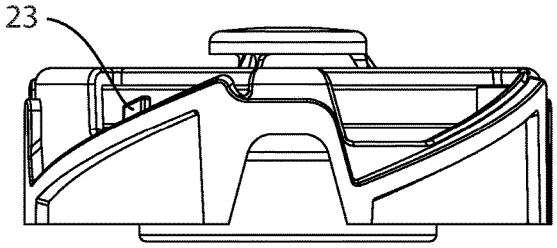
FIG. 5C is a side view of a first component of a closure.
Figure 6A:
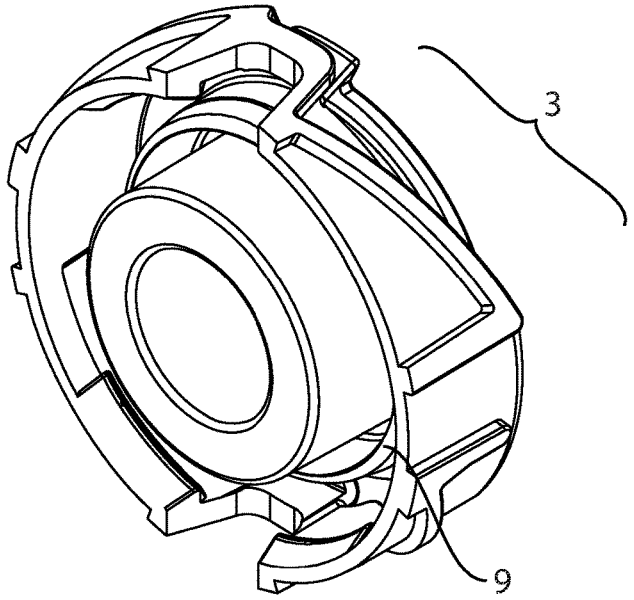
FIG. 6A is an isometric view of a first component of a closure.
Figure 6B:
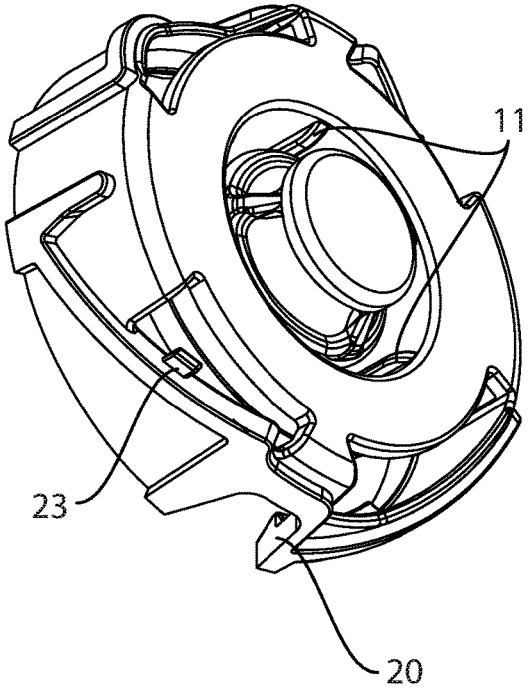
FIG. 6B is an isometric view of a first component of a closure.
Figure 7:
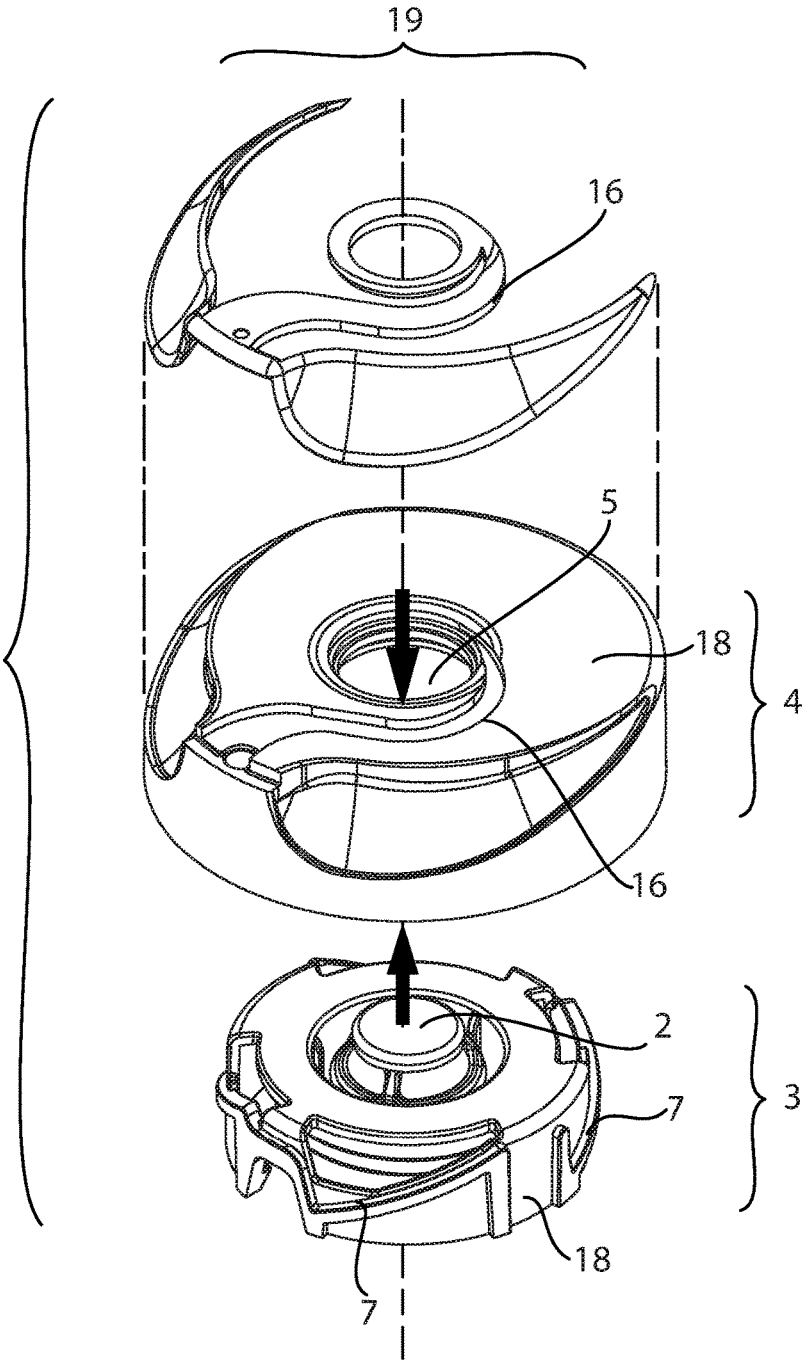
FIG. 7 is an exploded view of a closure.

According to the present invention a closure (1) for an outlet opening of a container comprises a first component (3) which snaps onto an outlet opening and provides a seal for an outlet opening. The first component comprises one or more rails to enable stability of the closure (1) assembly and determines the direction of movement of the second component (4) relative to the first component (3) of the closure (1). The (3) connects the second component (4) with the container. The first component (3) provides a sealing mechanism for the container and first component (3) as well as providing sealing between the first and second component (4). Nonlimiting examples of a sealing mechanism include a plug seal (9), a telescoping seal (8), a membrane seal, a crab claw seal, a silicone membrane seal, spin or ultrasonic welding, glue adhesive and mixtures thereof. In an embodiment of the present invention, the sealing mechanism for the container and first component (3) is a plug seal (9) and the sealing between the first component (3) and the second component (4) is a telescoping seal (8). A telescoping seal (8) may enable dynamic sealing between the first component (3) and second component (4). The telescoping seal (8) maintains the seal as the user operates/actuates the closure (1).

In an embodiment of the present invention the first component (3) comprises one or more rails to enable stability of the assembly and determines the direction of movement of the second component (4) relative to the first component (3). In an embodiment of present invention, a second component (4) comprising a dispensing orifice (5) may snap with the first component (3); wherein the second component (4) comprises rib(s) (6) which engage the rail(s) (7) of the first component (3). In an embodiment of the present invention, a dispensing orifice (5) may be positioned directly adjacent to the open portion of a container body.

Figure 8:
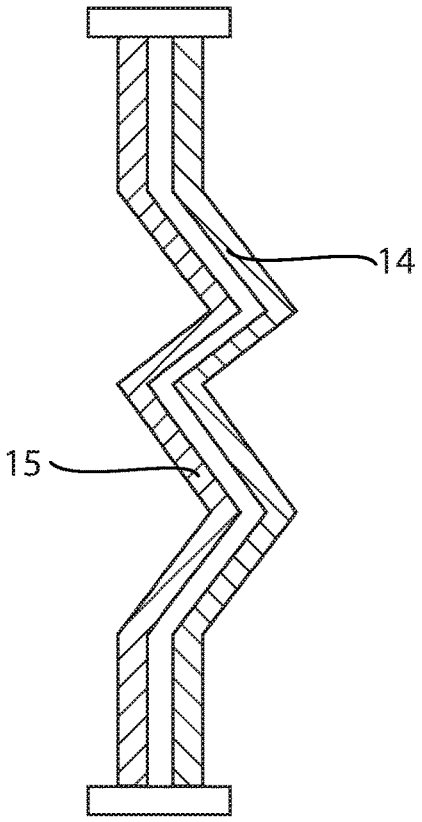
FIG. 8 is a thread female geometry and thread male geometry.
Figure 9:
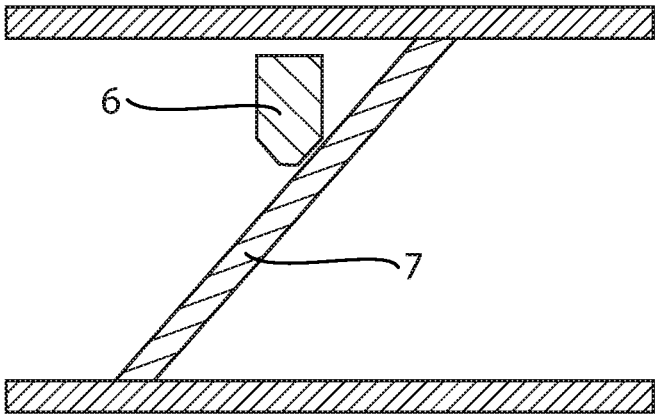
FIG. 9 is a rail and a rib geometry.
Figure 10:
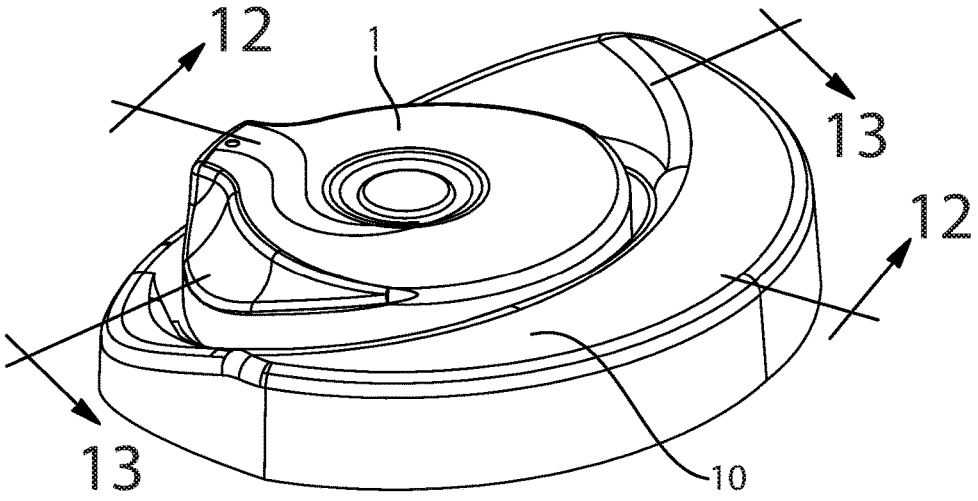
FIG. 10 is an isometric view of a closure integrated with a shoulder of a container.
Figure 11:
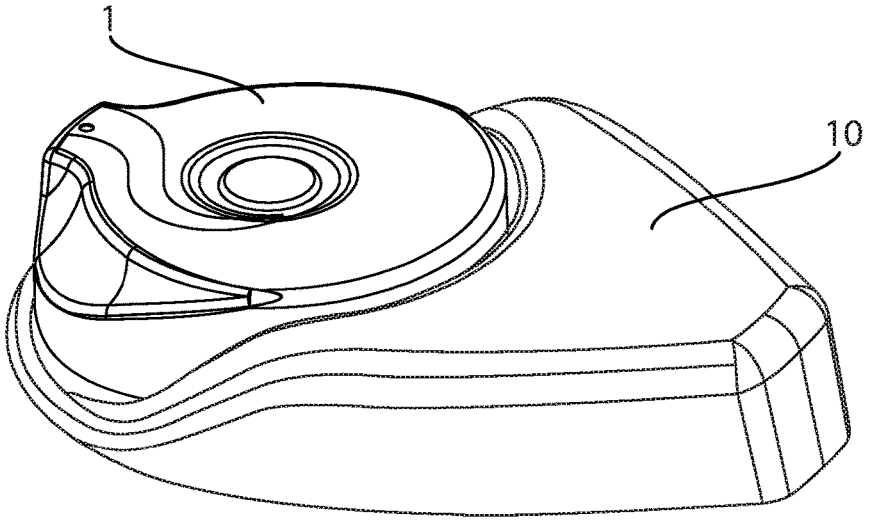
FIG. 11 is an isometric view of a closure integrated with a shoulder of a container.
Figure 12:
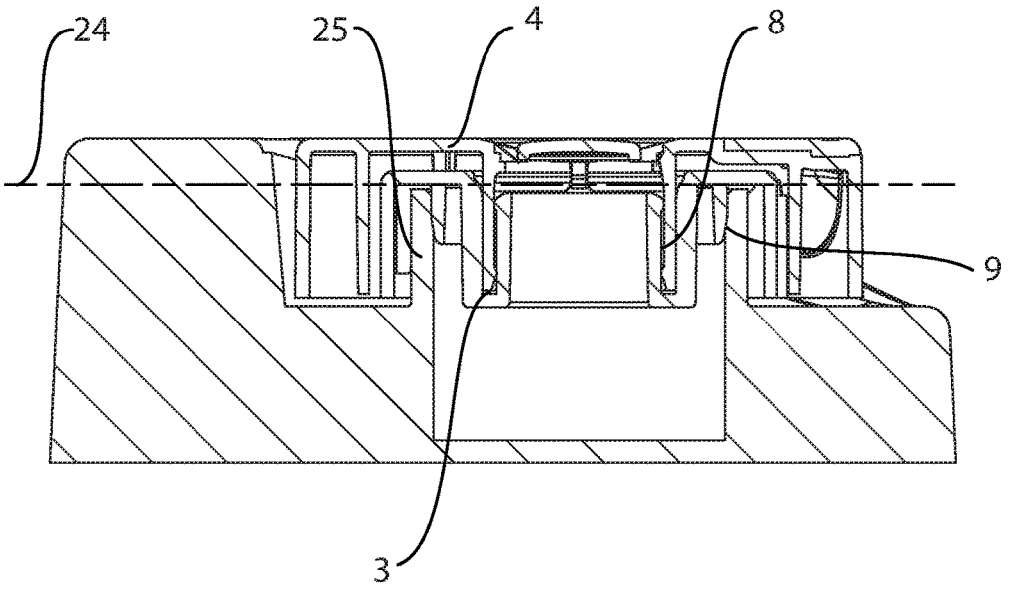
FIG. 12 is a cross section view of closure and container of FIG. 10.
Figure 13:
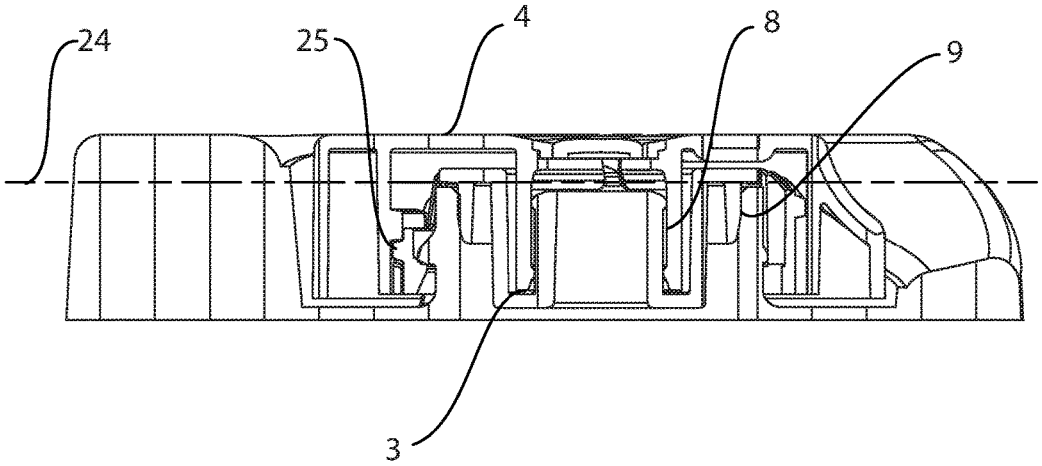
FIG. 13 is a cross section view of closure and container of FIG. 10.

In an embodiment of the present invention, a thread comprises a female and male helical geometry used to convert rotational displacement to linear displacement. Either geometry (female or male) comprises a top and bottom helical surface to enable engagement or fitment of one against the other. This geometry can be molded by having stripping, unscrewing mechanisms or side actions in the injection-molding tool. Further, in a conventional mold, by stripping the threads of the tool, it enables straight pull tool design while limiting the robustness of engagement between the plastic components. When stripping undercuts, there is a maximum possible undercut depth that the industry can strip today for a given hoop strength of a component, without damaging the component. This limits the robustness in stability and integrity of the assembly of both components. For unscrewing or side actions, this will typically add an extra 15%-35% of additional cost depending on part and tool design complexity. They both require a large amount of space to accommodate the tooling components as well as the extra space needed for lateral movement of moving components. According to FIG. 8, in an embodiment of the present invention, a conventional thread female (14) and conventional thread male (15) geometry is demonstrated. The present invention comprises rib(s) (6) and rail(s) (7) to enable the conversion of rotational movement to linear movement. Different from conventional threads, the rail(s) (7) and rib(s) (6) of the present invention can be molded in a straight pull fashion. They do not require sophisticated moving parts in the tool and the cost minimized and efficiency maximized. Both the rib(s) (6) and rail(s) (7) can be molded with a simple open and closing of the mold. According to FIG. 9, in an embodiment of the present invention, the rib(s) (6) and rail(s) (7) geometry is demonstrated.

In an embodiment of the present invention, the closure (1) may use rail(s) (7) and rib(s) (6) with alternated up and down locations for the rib(s) (6). The rail(s) (7) and rib(s) (6) are the mechanical features that control the direction and retention of the second component (4) and first component (3). As demonstrated in FIG. 9, by doing this, the upward/downward retention of the closure (1) assembly and linear translation of second component (4) relative to first are independently controlled. In a conventional thread, such retention and linear translation may be achieved via the interaction of the female and male helical geometry.

By having anchor ribs (11) in either the first component (3) or the second component (4), the integrity of the assembly increases and therefore more stable the assembly will be. The anchors can limit the side-to-side movement (or wobble) of the second component (4) relative to the first component (3).

By having anchor ribs (11) in either first or second component (4), the integrity of the assembly increases and therefore more robust the engagement of the assembly will be. This is because the anchors are limiting the side-to-side movement (wobble) of the second component (4) and consequently they increase the retention force of the second component (4) relative to the first component (3). The anchor ribs (11) increase the engagement of the retention feature that enables the second component (4) to stay together with the first component (3).

In one embodiment of the present invention, in order to allow a user to reveal the dispensing orifice (5) of a package, a closure (1) may be designed with various different types of movements. A closure (1) may move by rotational movement along an axis, diagonal movement, and horizontal movement, vertical movement, a twist movement, elevate movement, slide movement, and mixtures thereof to reveal a dispensing orifice (5).

In an embodiment of the present invention, the ribs and rails of either first or second component can be made of any material selected for either first or second component.

In comparison to the conventional twist to open closures, where the direction/movement and the retention of one piece to the other are achieved via the use of threads, the present invention enables the independent control of the direction and retention of the second component relative to the first component (3) via the use of ribs and rails. The stability of the second component relative to the first component (3) is a benefit for the consumer. The stability enables the rotational movement of the second component relative to the first component (3). It also ensures proper alignment and interaction of the mechanical features of the closure (1).

In an embodiment of the present invention, the first component (3) and second component (4) comprises an anti-rotating feature (20) to prevent free movement of the closure (1). An anti-rotating feature can prevent the first component (3) to spin freely, relative to a container neck opening. In an embodiment of the present invention, the first component (3) and second component (4) comprise an audible mechanism (23) which may communicate to the user when the closure (1) is either closed or open. In a further embodiment of the present invention, the first component (3) may comprise a snap ring(s) which enables the first component (3) to be securely attached to the neck of the container. In a further embodiment, threads, glue, welding or other similar mechanical or chemical means may be used for the same purpose of secure attachment to the neck of the container.

In an embodiment of the present invention, a second component (4) comprises a dispensing orifice (5) wherein the second component (4) is engaged via a rib(s) (6) and rail(s) (7) with the first component (3). The second component (4) may comprise components that contribute to the user interface. Such component comprises the color/shape differentiation as well as the tactile features (13) and ergonomic intuitive design components. It also may have the counter part mechanisms for the audible, telescoping seal (8), dispensing orifice, rib(s) and rail(s) mechanisms, and anti rotating (20) features.

In an embodiment in the present invention, a dispensing orifice (5) positioned directly adjacent to the open portion of the container body wherein the second component (4) will engage with the first component (3) when the second component (4) is moved relative to the first component (3) to enable operation of the orifice and wherein the first component (3) comprises one or more elements/one or more mechanical features being in a specific juxtaposition enabling a small height/low profile/a narrow profile for one or more (the majority of) of the mechanical features/elements of the first component (3) wherein the telescoping seal (8) and the mechanical features supporting the operation of the closure (1) are in the plane or below the plane of the outlet of the container (25). Most of the features within the first component are located at or below the plane of the container opening outlet (24). This enables the features to be placed at locations that are conventionally considered dead space. This allows for a design that has significantly less height than typical closures and as a result significant weight reduction of the overall closure (1) is achieved. This will not only enable significant manufacturing cost reduction but, will also enable sustainability improvement by developing a closure (1) than can be manufactured in half or less time (due to less energy consumption) and less gram weight utilization (due to reduction in waste) than average closures.

In an embodiment of the present invention, wherein the first component (3) comprises one or more elements or one or more mechanical features being in a specific juxtaposition enabling a small height/low profile/a narrow profile regardless of the diameter of the container opening.

In an embodiment of the present invention, the height or distance of the specific juxtaposition may stay constant regardless of the size of the diameter of container opening. For example, the low profile needed for a small container opening may stay constant for a larger container opening.

In an embodiment of the present invention, the first component (3) may comprise one or more sealing regions, such as a plug seal (9) and telescoping seal (8) located on the top of the neck or extending beyond the top plane of the neck or top plane/surface of the neck and inside the neck of the container or it is located within the height of the neck or below the neck of the container enabling a small height or low profile for mechanical features/elements of the first component (3).

In a further embodiment of the present invention, the first component (3) may comprise one or more elements located at or below a plane defined by a top region/area of a neck outlet of the container enabling a small height or low profile for all of the mechanical features/elements of the first component (3).

In an embodiment of the present invention, a closure (1) for an outlet opening of a container is provided comprising a first component (3) which snaps onto an outlet opening and provides a seal for an outlet opening said first component (3) is engaged to a second component (4) of said closure (1); a second component (4) comprising a dispensing orifice (5) of the second component (4), the second component (4), engaged with the first component (3); a dispensing orifice (5) positioned directly adjacent to the open portion of the container body; wherein the second component (4) will engage with the first component (3) when the second component is moved relative to the first component (3) to enable operation of the orifice and wherein a full assembly of the first component (3) and the second component (4) comprises at least two materials.

In one embodiment of the present invention, in order to allow a user to reveal the dispensing orifice (5) of a package, a closure (1) may be designed with various different types of movements. A closure (1) may move by rotational movement along an axis, diagonal movement, and horizontal movement, vertical movement, a twist movement, elevate movement, slide movement, and mixtures thereof to reveal a dispensing orifice (5).

To achieve the above directional movement, in an embodiment of the present invention, the following mechanical features may be designed in the closure (1); female/male thread interface, rib(s) and rail(s), a flow channel that may have a telescoping mechanism, a cylindrical, an elliptical, a square, or triangular shape; pivot points, swivel hinge type mechanisms and mixtures thereof.

In one embodiment of the present invention, the first component (3) comprises a rib (6) component to engage with said second component (4) and the second component (4) comprises a rail (7) component which is a counterpart feature component of the closure (1). In a further embodiment of the present invention, the first component (3) comprises a rail component to engage with said second component (4) and the second component (4) comprises rib (6) component which is a counterpart feature component of the closure (1). In a further embodiment, the first component (3) may comprise a combination of rib(s) (6) and rail(s) (7) and the second component (4) may comprise a combination of rib(s) (6) and rail(s) (7) as well.

The rib(s) (6) and rail(s) (7) features allows the first component (3) and second component (4) to stay together as one component. The rib(s) (6) and rail(s) (7) components also enable the closure (1) movement from a lower position to an elevated position. This allows the user to reveal the dispensing orifice (5) and hence dispense a fluid.

In an embodiment of the present invention, the second component (4) is moved in a concentrical movement, linear movement, axial movement, radial movement, co-radial movement, eccentrical movement, spiral movement and mixtures around the first component (3).

The dispensing orifice (5) may be revealed in different ways. For example, in a rotate/twist to open closure (1), the dispensing orifice (5) is opened via a rib(s) (6)/rail(s) (7) interaction where the first component (3) rotates/spins within it's axis of rotation, concentrically to the second component (4).

In a further embodiment of the present invention, the closure (1) is integrated with a body of a container. By having a closure (1) as small as functionally possible; it may provide a centered or an offset of the closure (1) to one side and have the container shoulder flush to the closure (1) top surface. It also provides full integration of the closure (1) within the shoulders (10) of a container (1).

In an embodiment of the present invention, the closure (1) is integrated with a body of a container wherein geometry of the closure (1) acts in completing the silhouette of the body of the container. In an inverted orientation a recessed closure allows the use of a container shoulder to add stability vs. requiring a full size closure on top of a container.

In a further embodiment of the present invention, closure geometry provides a surface for optimal leverage to operate a closure. A closure (1) is operated by a single hand of a user or by two hands of a user. A closure (1) may have features which enhance ergonomics such as the nonlimiting examples of handles, levers, alternative materials, textures, specific shaped contours, and combinations thereof. These features are strategically positioned to enable ease of use with either wet or dry hands. For example; in a twist/rotate to open closure that uses rib(s) (6)/rail(s) (7), the further away the lever or point of opening is from the axis of rotation, the easier the opening of the closure will be for the same area of applied pressure. In other words, the further the distance from the axis of rotation is, the less force will be required by the consumer to open the closure for a specific torque. The closure design could either have an enhanced shroud design for ease of use or ergonomically incorporated levers. In an embodiment, the further the distance from the axis of rotation, the less force will be required by a consumer to open a closure (1) for a specific torque.

In an embodiment of the present invention, a closure (1) may comprise a mechanism that suspends one component relative to the other component to ensure a closure remains closed or open. As part of a twist/rotate motion to open a closure, the first component (3) and/or second component (4) may have bumps or protrusions (12) in either a rib(s) (6) or a rail(s) (7) that will prevent a closure to close while opened or to open while closed. When the rib(s) (6) passes over the protrusions (12) or bump, the closure will lock in place and thus not allowing a closure second piece to open or close by itself.

In a further embodiment of the invention, a closure (1) comprises a second component (4) which comprises an orienting mechanism which enables a specific orientation of closure components relative to an outlet opening of a container. In this embodiment, a closure (1) has either a male mechanism or female mechanism that interacts with the male or female mechanism of a container to prevent free rotation and enable closure orientation for proper closure operation.

In an embodiment of the present invention, a closure (1) comprises a first component (3) comprising an orienting mechanism which enables a specific orientation of the other closure components relative to the first component (3). This embodiment comprises a design that takes advantage of a first component (3) having rail(s) (7) and second component (4) having rib(s) (6) to create an anti-rotating mechanism. This enables alignment of the first component (3) relative to the second component (4) and prevent further rotation between the first component (3) and a second component (4).

In an embodiment of the present invention, a closure (1) rotates around an axis between an open and a close position. In a twist/rotate to open closure a second component (4) is rotated around an axis to move the second component (4) relative to a first component (3) between a lower and elevated position, allowing a user to reveal the dispensing orifice (5) of the second component (4).

In a further embodiment of the present invention, the first component (3) or second component (4) may have rails with a variable pitch. By having a variable pitch the consumer has the ability to open and close the closure (1) in either clockwise or counterclockwise direction. This will enable consumers that are right or left-handed use the same closure. This is in contrast to currently available twist closures where they only open in either clockwise or counterclockwise direction.

In a further embodiment of the present invention, the first component (3) or second component (4) may have multi stage opening bumps for metered dosing. By having a multistage opening closure the consumer will be capable of opening the closure at different heights and therefore control the size of the dispensing orifice (5) opening. This will enable the consumers to dispense their preferred amount from the container. This is in contrast to currently available twist were consumers have limited control over the amount that they dispense from their containers. The present invention will enable the consumer to always dose the same exact amount every single time.

In a further embodiment of the present invention, the second component (4) may be exchanged with different sizes. The second component (4) of the closure (1) can be modified in size to increase the closure presence on shelf as well as to enhance closure grip ability. This can be done by interchanging mold inserts for the exterior wall of the second component (4). The mechanical features can be considered locked and no further adjustments will be necessary.

In a further embodiment of the present invention, a closure (1) comprises tactile features (13) and/or visual features (16) that provide a user with direction on how to operate the closure. The closure (1) will incorporate tactile features (13) and visual features (16) that will cue or communicate to a user to know where to press/push/hold and which direction the force needs to be applied.

In an embodiment of the present invention, a closure (1) comprises an audible sound mechanism. In an embodiment, a closure (1) may have a cantilever feature or a similar mechanical feature that will generate a sound as the user manipulates a closure from an open to a closed position. This will communicate to a user when a closure is fully opened and when a closure is fully closed.

In a further embodiment of the present invention, a closure (1) is comprised of a sustainable material. The closure (1) may be manufactured completely with sustainable materials or either the first component (3) or second component (4) only. This may allow for a more recyclable closure. Some of the materials that could be used are: PCR, HDPE, LDPE, Bamboo, renewable resins include PLA (polylactic acid), PHA (polyhydroxyalkanoate), and bio-polyolefins (bio-PE, bio-PP, bio-PET), where starting materials are plants or biomass instead of oil; recycled and recyclable resins include PP PCR (post consumer regrind) and PIR (post industrial regrind), which are resins diverted from trash to be reprocessed and/or reused instead; Natural fillers include minerals (e.g. CaCO3), wood, pulp, paper, bamboo, grass, kenaf, bulrush, and other natural plants that have been crushed, cut, broken, or pulverized for inclusion in plastics; renewable resins include PLA (polylactic acid), PHA (polyhydroxyalkanoate), and bio-polyolefins (bio-PE, bio-PP, bio-PET), where starting materials are plants or biomass instead of oil; recycled and recyclable resins include PP PCR (post consumer regrind) and PIR (post industrial regrind), which are resins diverted from trash to be reprocessed and/or reused instead; some recycled miscellaneous materials can be used as fillers, including waste currency. (e.g. U.S. dollar bills).

In a further embodiment of the present invention, a container made by the present invention wherein the container is comprised of a biodegradable polymer material selected from the group consisting of polyglycolic acid (PGA), polybutylene succinate (PBS), an aliphatic-aromatic copolyester based on terephthalic acid, an aromatic copolyester with a high terephthalic acid content, thermoplastic starch (TPS), cellulose, or a mixture thereof.

The sustainable materials may include biopolymers made from non-petroleum sources, biodegradable polymers, recycled resins and mixtures thereof. Some of the potential biopolymers that could be used for this application are: bamboo, paper, and grass. A non-petroleum source may be selected from the group consisting of bio-derived polyethylene, bio derived polypropylene, bio derived polyesters and mixtures thereof. Some or all of the sustainable material may contain colorants, antistatics, UV inhibitors, or other small quantity additives to change the appearance or performance.

In an embodiment of the present invention, a closure (1) may comprise at least two materials. A closure (1) may be molded with a hard material (18) (such as a polypropylene (PP) like resin) and a soft material (19). In a further embodiment of the presents invention such hard materials may be hard resins such as Polyolefin resins, such as Polyethylene PE and polypropylene PP; Acrylates, such as Poly methyl acrylate, PMA; Carbonates such as Polycarbonate PC; Carbonates, such as Polycarbonate PC; Methacrylates, such as poly methyl methacrylate PMMA; Amides such as Nylon 6; Acetal; Copolymers, such as Acrylonitrile butadiene styrene—ABS; Chlorinated Polymers, such as Poly vinyl chloride PVC; Styrenics, such as Polystyrene PS; Esters, such as polyethylene terephthalate PET; Modified Esters such as PETG; Polyformaldehyde such as Delrin; Methacrylates, such as poly methyl methacrylate PMMA; Amides, such as Nylon 6; Acetal; Copolymers such as Acrylonitrile butadiene styrene ABS; Chlorinated Polymers, such as Poly vinyl chloride PVC; Styrenics, such as Polystyrene PS; Esters, such as polyethylene terephthalate PET; Modified Esters, such as PETG; and Polyformaldehyde, such as Delrin.

In a further embodiment, a closure (1) may be molded with a soft material (19). Such soft material (19) may include soft injection moldable resins; Thermoplastic elestomers; TPE including styrenic (SEBS and SBS) based and olefin (TPO PP Elastomer) based; Thermoplastic eurothanes TPU; Melt Processable Rubber MPR; Thermoplastic Vulcanizate TPV; and Poly vinyl chloride PVC and mixtures thereof. In an embodiment of the present invention, the soft like material may delight the consumer with a soft touch feel while opening and closing the closure.

In a further embodiment of the present invention, soft resins that are not injection molded may be used, such as silicone; and urethane rubbers.

In a further embodiment of the present invention, a closure (1) may comprise materials which may improve functional performance (sealing, ergonomics, stability on storage surfaces, visual aid for user, container durability, customized the tactile and audible signals to the user and mixtures thereof). A TPE or silicone like material will enable for a more robust seal between the dispensing orifice (5) and a spud (2) design. In the present application, the softer material (19) will tend to conform to the shape of the spud (2) design, allowing for a better seal vs. PP to PP components.

The closure (1) may also incorporate dissimilar materials between the first component (3) and the second component (4) to lower the coefficient of friction between both components. Materials combinations that may be used are PP/PP, HDPE/PP, LDPE/PP, Acetel/PP, Bamboo/PP and mixtures thereof.

In a further embodiment of the present invention, a closure (1) is operated by a single hand of a user or by two hands of a user. A closure (1) may have features which enhance ergonomics such as handles, levers, alternative materials, textures, specific shaped contours, and combinations thereof. These features are strategically positioned to enable ease of use with either wet or dry hands. For example; in a twist/rotate to open closure that uses female/male threads, the further away the lever or point of opening is from the axis of rotation, the easier the opening of the closure will be for the same area of applied pressure. In an embodiment, the further the distance from the axis of rotation, the less force will be required by a consumer to open a closure (1) for a specific torque.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A closure for an outlet opening of a container comprising:

a) a first component which snaps onto an outlet opening and provides a seal for an outlet opening said first component snaps on with a second component of said closure; wherein the first component comprises one or more rails and defines the direction of movement of the second component relative to the first component b) a second component comprising a dispensing orifice of said second component, said second component, snaps on with said first component; wherein the second component comprises ribs which engage the rail(s) of said first component c) a dispensing orifice positioned directly adjacent to the open portion of the container body;

wherein one or more directions of the movement of the second component relative to the first component are independently controlled by rails and ribs wherein the closure comprises rail(s) and rib(s) with alternated up and down locations for the rib(s) wherein the first component comprises anchor ribs which increase a retention force of the second component relative to the first component and wherein the first component comprises one or more elements being in a specific juxtaposition enabling a small height and a low profile for one or more of the elements of the first component wherein a telescoping seal and elements supporting the operation of the closure are in the plane or below the plane of the outlet of the container.

2. A closure according to claim 1 wherein the first component comprises at least 2 rails or ribs.

3. A closure according to claim 1 wherein the second component comprises at least 2 rails or ribs.

4. A closure according to claim 1 wherein the first component comprises anchor.

5. A closure according to claim 1 wherein the closure will move in a method selected from the group consisting of twist, elevate, slide, diagonally, horizontally, rotating and mixtures thereof to define a dispensing orifice.

6. A closure according to claim 1 wherein the closure comprises at least two materials.

7. A closure according to claim 1 wherein the dispensing orifice is formed by the orientation of the first component to the second component or the orientation of the second component to the first component.

8. A closure according to claim 1 wherein the first component comprises a rail(s) features to engage with said second component and the second component comprises a rib(s) counterpart feature of the closure.

9. A closure according to claim 1 wherein the second component comprises a rib(s) feature to engage with said first component and the first component comprises a rail(s) counterpart feature component of the closure.

10. A closure according to claim 1 wherein the second component is moved in concentric movement around the first component.

11. A closure according to claim 1 wherein the closure is integrated with a body of a container.

12. A closure according to claim 1 wherein the first or second component comprises rails with a variable pitch.

13. A closure according to claim 1 wherein the second component can be exchanged with different (shroud) sizes.

14. A closure according to claim 1 wherein the closure is integrated with a body of a container wherein geometry of the closure functions in completing the silhouette of the body of the container.

15. A closure according to claim 1 wherein the closure is operated by a single hand of a user or two hands of a user.

16. A closure according to claim 1 wherein the closure and a container connected to the closure are held by a single hand of a user and closure is operated by a single digit of the single hand.

17. A closure according to claim 1 wherein the closure comprises a mechanism that suspends one component relative to the other component to ensure a closure remains closed or open.

18. A closure according to claim 1 wherein the closure comprises tactile features.

19. A closure according to claim 1 wherein the closure comprises visual features.

20. A closure according to claim 19, wherein the closure comprises the visual features which provide the user with direction on how to operate the closure.

21. A closure according to claim 1 wherein the closure comprises an audible sound mechanism.

22. A closure according to claim 1 wherein the closure is comprised of a sustainable material.

23. A closure according to claim 22 wherein the sustainable material is selected from the group consisting of biopolymers made from non-petroleum sources, biodegradable polymers, recycled resins and mixtures thereof.

24. A closure according to claim 23 wherein the non-petroleum source is selected from the group consisting of bio-derived polyethylene, bio derived polypropylene, bio derived polyesters and mixtures thereof.

25. A closure according to claim 1 wherein the closure comprises materials for functional performance selected from the group consisting of sealing, ergonomics, stability on storage surfaces, visual aids for user, container durability, customization of tactile and audible signals to the user and mixtures thereof.

26. A closure according to claim 25 wherein the closure comprises material selected from the group consisting of polyolefin resins, polyethylene PE, polypropylene PP; Acrylates, poly methyl acrylate, PMA; carbonates, polycarbonate PC; carbonates, polycarbonate PC; methacrylates, poly methyl methacrylate PMMA; amides, Nylon 6, acetal, copolymers, acrylonitrile butadiene styrene, ABS; chlorinated polymers, poly vinyl chloride PVC; styrenics, polystyrene PS; Esters, polyethylene terephthalate PET; modified esters, PETG, polyformaldehyde Delrin; methacrylates, poly methyl methacrylate PMMA; amides, Nylon 6, acetal, copolymers Acrylonitrile butadiene styrene—ABS, chlorinated polymers, poly vinyl chloride PVC; styrenics, such as polystyrene PS, esters, polyethylene terephthalate PET, modified esters, such as PETG, and polyformaldehyde, delrin and mixtures thereof.

27. A closure according to claim 19 wherein the closure comprises a soft material selected from the group consisting of thermoplastic elestomers; TPE, styrenic (SEBS and SBS)

based and olefin (TPO PP Elastomer) based, thermoplastic eurothanes TPU, melt processable rubber MPR, thermoplastic vulcanizate TPV, and poly vinyl chloride PVC and mixtures thereof.

28. A closure according to claim 1 wherein the closure geometry provides a surface for leverage to operate the closure.

* * * * *